US006959883B2

(12) United States Patent
Omae

(10) Patent No.: US 6,959,883 B2
(45) Date of Patent: Nov. 1, 2005

(54) FUEL INJECTION VALVE

(75) Inventor: Kazuhiro Omae, Atsugi (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 11/066,138

(22) Filed: Feb. 25, 2005

(65) Prior Publication Data

US 2005/0211804 A1 Sep. 29, 2005

(30) Foreign Application Priority Data

Mar. 29, 2004 (JP) ..... 2004-095219

(51) Int. Cl.[7] ..... B05B 1/30

(52) U.S. Cl. ..... 239/585.1; 239/585.3; 239/585.5; 239/533.2; 239/533.3; 239/533.11; 239/533.12

(58) Field of Search ..... 239/585.1, 585.2, 239/585.3, 585.4, 585.5, 533.2, 533.3, 533.8, 239/533.9, 533.11, 533.12; 251/129.15, 129.16, 251/129.18

(56) References Cited

U.S. PATENT DOCUMENTS 4,200,237 A * 4/1980 Urlaub et al. ..... 239/533.12
4,269,360 A * 5/1981 Kopse ..... 239/533.8
5,058,549 A * 10/1991 Hashimoto et al. ..... 123/298
5,271,565 A * 12/1993 Cerny ..... 239/533.8

FOREIGN PATENT DOCUMENTS

| | | |
|---|---|---|
| JP | A 10-274127 | 10/1998 |
| JP | A 2003-113754 | 4/2003 |
| JP | A 2003-184691 | 7/2003 |
| JP | A 2003-254189 | 9/2003 |

* cited by examiner

*Primary Examiner*—Dinh Q. Nguyen
(74) *Attorney, Agent, or Firm*—Oliff & Berridge, PLC

(57) ABSTRACT

When a needle is separated from a needle seat, upward pressure of pressurized fuel is applied to downward pressure receiving surface outer portion and an annular downward pressure receiving surface inner portion. A bottom portion side extending portion is provided, which extends in a direction of a longitudinal axis K—K from a needle bottom surface inner portion, which is a portion of a bottom surface of the needle on an inner side of the annular seal, into a sack beyond a nozzle chamber. When the needle is separated from the needle seat, an area of the downward pressure receiving surface inner portion to which the upward pressure of the pressurized fuel is applied is decreased by a cross sectional area of the bottom portion side extending portion.

10 Claims, 12 Drawing Sheets

FUEL INJECTION VALVE

The disclosure of Japanese Patent Application N2004-095219 filed on Mar. 29, 2004 including the specification, drawings and abstract is incorporated herein by reference in its entirety.

BACKGROUND OF THE INVENTION

1. Field of the Invention

The invention relates to a fuel injection valve.

2. Description of the Related Art

A fuel injection valve for a compression ignition internal combustion engine 1' as shown in FIG. 11A, FIG. 11B, FIG. 12A, and FIG. 12B is known. In this fuel injection valve 1', a nozzle chamber 5', and a coil chamber 6' are formed in a housing 2'. A sack 7' is formed at a bottom end of the nozzle chamber 5'. A nozzle 8' is provided in a peripheral surface of the sack 7'. The coil chamber 6' is connected to a top end of the nozzle chamber 5' through a slide portion 9'. A needle 10' extends from the nozzle chamber 5' to the coil chamber 6' through the slide portion 9'. The needle 10' is slidably supported in the slide portion 9'.

The nozzle chamber 5' is connected to a common rail (not shown) through a fuel port 14'. The coil chamber 6' is connected to the nozzle chamber 5' through a pressurized fuel supply passage 15'. These nozzle chamber 5' and the coil chamber 6' are filled with pressurized fuel. A solenoid coil 11' and a fixed core 12' are fixed in the coil chamber 6'. An armature 13' is formed on the needle 10' at a portion positioned in the coil chamber 6' such that the armature 13' is opposed to the solenoid coil 11'. A compression spring 24' is inserted between an inner wall surface of the housing and an outer surface of the needle. The compression spring 24' applies force to the needle 10' in a valve closing direction.

Particularly as apparent from FIG. 11B, a needle seat 16' is formed in an inner wall surface of a nozzle holder 3' adjacent to the sack 7'. When the needle 10' is seated at the needle seat 16', an annular seal 17' is formed between the needle 10' and the needle seat 16'.

As shown as a projection plane at a bottom of FIG. 11B, a downward pressure receiving surface 21' is formed in the needle 10' at a portion positioned in the nozzle chamber 5'. The downward pressure receiving surface 21' includes a downward pressure receiving surface outer portion 21*a'* and a downward pressure receiving surface inner portion 21*b*. The downward pressure receiving surface outer portion 21*a'* is an annular portion on a radially outer side of the aforementioned annular seal 17'. The downward pressure receiving surface inner portion 21*b'* is a portion on an inner side of the downward pressure receiving surface outer portion 21*a'* and the annular seal 17'. Meanwhile, an upward pressure receiving surface 23' is formed in the needle 10' at a portion positioned in the coil chamber 6'. The upward pressure receiving surface 23' is shown also as a projection plane at a top portion of FIG. 11B.

Each of FIG. 11A and FIG. 11B shows the fuel injection valve 1' when closed. In this case, the solenoid coil 11' is de-energized. The needle 10' remains seated in the needle seat 16', whereby fuel injection is stopped.

When fuel injection should be started, the solenoid coil 11' is energized. As a result, upward magnetic attraction force of the solenoid coil 11' is applied to the needle 10', and the needle 10' is displaced upward, and is separated from the needle seat 16'. Then, fuel injection is started. Subsequently, when the armature 13' hits a bottom end surface of the fixed core 12', upward displacement of the needle 10' is restricted.

When the fuel injection should be stopped, the solenoid coil 11' is de-energized. As a result, the needle 10' is displaced downward by spring force of the compression spring 24'. Subsequently, when the needle 10' is seated at the needle seat 16' as shown in FIG. 11A and FIG. 11B, the fuel injection is stopped.

When the fuel injection is stopped as shown in FIG. 11A and FIG. 11B, downward pressure of pressurized fuel is applied to the upward pressure receiving surface 23', upward pressure of pressurized fuel is applied to the downward pressure receiving surface outer portion 21*a'*, and the pressure of pressurized fuel is not applied to the downward pressure receiving surface inner portion 21*b'*, as shown by hatcing in FIG. 12A. When the solenoid coil 11' is energized, the upward magnetic attraction force is applied to the needle 10'. Accordingly, in this case, the solenoid coil 11' is required to supply the magnetic attraction force such that the needle 10' is separated from the needle seat 16' by the upward magnetic attraction force of the solenoid coil 11' and the upward force applied to the downward pressure receiving surface outer portion 21*a'*, against the downward force applied to the upward pressure receiving surface 23' and the downward spring force of the compression spring 24'.

When the needle 10' is separated from the needle seat 16', the upward pressure of pressurized fuel is applied not only to the downward pressure receiving surface outer portion 21*a'* but also to the downward pressure receiving surface inner portion 21*b'*, as shown by hatching in FIG. 12B. Subsequently, when the solenoid 11' is de-energized, the upward magnetic attraction force is no longer applied to the needle 10'. Accordingly, in this case, the compression spring 24' is required to supply the spring force such that the needle 10' is displaced downward to the needle seat 16' by the downward force applied to the upward pressure receiving surface 23' and the downward spring force of the compression spring 24', against the upward force applied to the downward pressure receiving surface outer portion 21*a'* and the upward force applied to the downward pressure receiving surface inner portion 21*b'*.

In the aforementioned fuel injection valve, when the needle 10' is separated from the needle seat 16', an area of the pressure receiving surface to which the upward pressure of pressurized fuel is applied is increased by an area of the downward pressure receiving surface inner portion 21*b'*, as compared to when the needle 10' is seated at the needle seat 16'. Accordingly, as apparent from the aforementioned requirement for the compression spring 24', the spring force of the compression spring 24' needs to be increased. Therefore, as apparent from the aforementioned requirement for the solenoid coil 11', the magnetic attraction force of the solenoid coil 11' needs to be increased. This signifies that an amount of energy consumed by the solenoid coil 11' becomes extremely large, or size of the solenoid coil 11' becomes large.

SUMMARY OF THE INVENTION

It is an object of the invention to provide a fuel injection valve in which magnetic attraction force required of a solenoid coil can be reduced.

In order to solve the aforementioned problem, a first aspect of the invention relates to a fuel injection valve including a housing constituting a main body of the fuel injection valve, a nozzle chamber and a coil chamber which are provided in the housing, a sack which is provided at one end portion of the nozzle chamber, a nozzle which is provided in a peripheral surface of the sack, a slide portion which is provided so as to connect the nozzle chamber to the coil chamber, a needle which extends from the nozzle chamber to the coil chamber through the slide portion, and which is supported in the slide portion so as to be slidable in a longitudinal axis direction, a pressurized fuel source which is connected to the nozzle chamber, and which supplies pressurized fuel to the nozzle chamber so that the nozzle chamber is filled with the pressurized fuel, a solenoid coil which is fixed in the coil chamber, an armature which is provided on the needle at a portion positioned in the coil chamber such that the armature is opposed to the solenoid coil, a compression spring which is inserted between an inner wall surface of the housing and an outer surface of the needle so as to apply force to the needle in a valve closing direction, and a needle seat which is provided in a vicinity of the nozzle, wherein when the needle is seated at the needle seat in the vicinity of the nozzle, an annular seal is formed between the needle and the needle seat, the fuel injection valve includes a bottom portion side extending portion that extends in the longitudinal axis direction from a needle bottom surface inner portion, which is a portion of a bottom surface of the needle on an inner side of the annular seal, into the sack beyond the nozzle chamber, when the needle is seated at the needle seat, upward pressure of the pressurized fuel is applied only to a downward pressure receiving surface outer portion that is an annular portion of a downward pressure receiving surface on an outer side of the annular seal, the downward pressure receiving surface being formed in the needle at a portion positioned in the nozzle chamber, when the needle is separated from the needle seat, the upward pressure of the pressurized fuel is applied to an entire portion of the downward pressure receiving surface, the entire portion excluding a cross sectional area of the bottom portion side extending portion.

In the first aspect of the invention, the configuration may be such that the bottom portion side extending portion is constituted by a bottom portion side bar-shaped member which is formed separately from the needle; a bottom portion side receiving portion which extends in the longitudinal axis direction and opens at the needle bottom surface inner portion is formed in the needle; and the bottom portion side bar-shaped member is movably housed in the bottom portion side receiving portion, and a bottom end of the bottom portion side bar-shaped member is positioned in the sack.

In an aspect relating to the first aspect of the invention, the configuration may be such that the fuel injection valve further includes a fuel escape passage, and the bottom portion side receiving portion is connected to the fuel escape passage on a side opposite to the needle bottom surface inner portion.

In the first aspect of the invention, the configuration may be such that the pressurized fuel source is connected to the coil chamber so that the coil chamber is filled with the pressurized fuel, and downward pressure of the pressurized fuel is applied to an upward pressure receiving surface which is formed in the needle at a portion positioned in the coil chamber; a top portion side extending portion is provided, the top portion side extending portion extending from a top surface of the needle that is positioned in the coil chamber to an inner wall surface of the coil chamber; the top portion side extending portion is fixed to the housing which defines the coil chamber, and is movable with respect to the needle, or the top portion side extending portion is fixed to the needle, and is movable with respect to the housing which defines the coil chamber; and a cross sectional area of the top portion side extending portion is set such that an area of the upward pressure receiving surface becomes substantially equal to an area of the downward pressure receiving surface when the needle is separated from the needle seat.

In an aspect relating to the first aspect of the invention, the configuration may be such that the top portion side extending portion is constituted by a top portion side bar-shaped member which is formed separately from the needle; a top portion side receiving portion which extends in the longitudinal axis direction, and opens at the inner wall surface of the coil chamber is formed in the housing; and the top portion side bar-shaped member is movably housed in the top portion side receiving portion, and a bottom end of the top portion side bar-shaped member is fixed to the top surface of the needle.

In the aspect relating to the first aspect of the invention, the configuration may be such that the top portion side extending portion is constituted by a top portion side bar-shaped member which is formed separately from the needle; a top portion side receiving portion which extends in the longitudinal axis direction, and opens at the top surface of the needle is formed in the needle; and the top portion side bar-shaped member is movably housed in the top portion side receiving portion, and a top end of the top portion side bar-shaped member is fixed to the housing which defines the coil chamber.

In an aspect relating to the first aspect of the invention, the configuration may be such that the bottom portion side extending portion is constituted by a bottom portion bar-shaped member which is formed separately from the needle; a bottom portion side receiving portion which extends in the longitudinal axis direction, and which opens at the needle bottom surface inner portion is formed in the needle; the bottom portion side bar-shaped member is movably housed in the bottom portion side receiving portion, and a bottom end of the bottom portion side bar-shaped member is positioned in the sack; a through portion is formed in the needle so as to extend through the needle in the longitudinal axis direction from the needle bottom surface inner portion to the top surface of the needle; and the top portion side receiving portion and the bottom portion side receiving portion are constituted by the through portion.

In the first aspect of the invention, the configuration may be such that the coil chamber is divided into a high pressure chamber and a low pressure chamber by a partition wall; the needle extends through the partition wall slidably and hermetically, and extends from the high pressure chamber to the low pressure chamber; the solenoid coil is positioned in the low pressure chamber, and the pressurized fuel source is connected to the high pressure chamber so that the high pressure chamber is filled with the pressurized fuel; and downward pressure of the pressurized fuel is applied to an upward pressure receiving surface that is formed in the needle at a portion positioned in the high pressure chamber.

Thus, according to the first aspect, it is possible to reduce the magnetic attraction force required of the solenoid coil.

In the aspect relating to the first aspect of the invention, the configuration may be such that the needle includes a small-diameter portion which extends through the partition wall slidably and hermetically; and a cross sectional area of the small-diameter portion is set so as to be substantially equal to the cross sectional area of the bottom portion side extending portion.

In the aspect relating to the first aspect of the invention, the configuration may be such that the needle includes a concave groove which is formed inside the needle; the concave groove is formed so as to be connected to the high pressure chamber; and a cross sectional area of an annular intermediate portion of the needle, which is formed by forming the concave groove, is set so as to be substantially equal to the cross sectional area of the bottom portion side extending member.

BRIEF DESCRIPTION OF THE DRAWINGS

The foregoing and further objects, features and advantages of the invention will become apparent from the following description of preferred embodiments with reference to the accompanying drawings, wherein like numerals are used to represent like elements and wherein.

DETAILED DESCRIPTION OF THE PREFERRED EMBODIMENTS

Hereinafter, description will be made of a case where the invention is applied to an in-cylinder direct injection fuel injection valve for a compression ignition internal combustion engine.

Figure 1A:
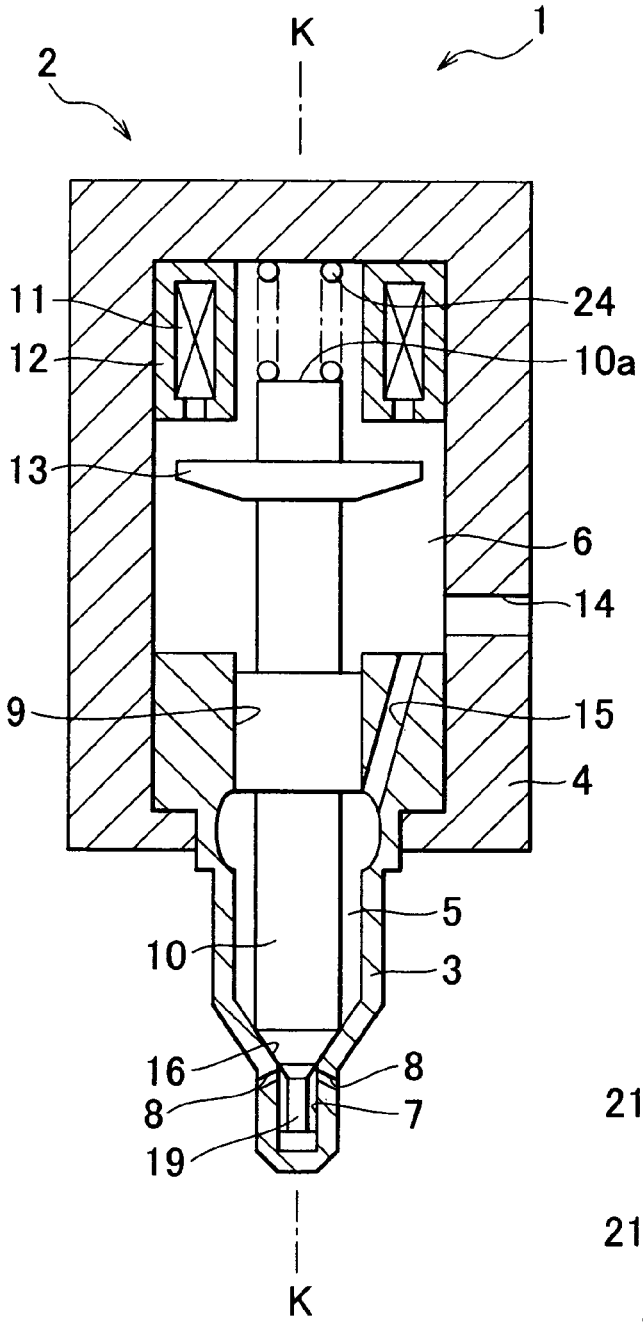
FIG. 1A and FIG. 1B are diagrams each showing a fuel injection valve according to a first embodiment of the invention when closed.
Figure 1B:
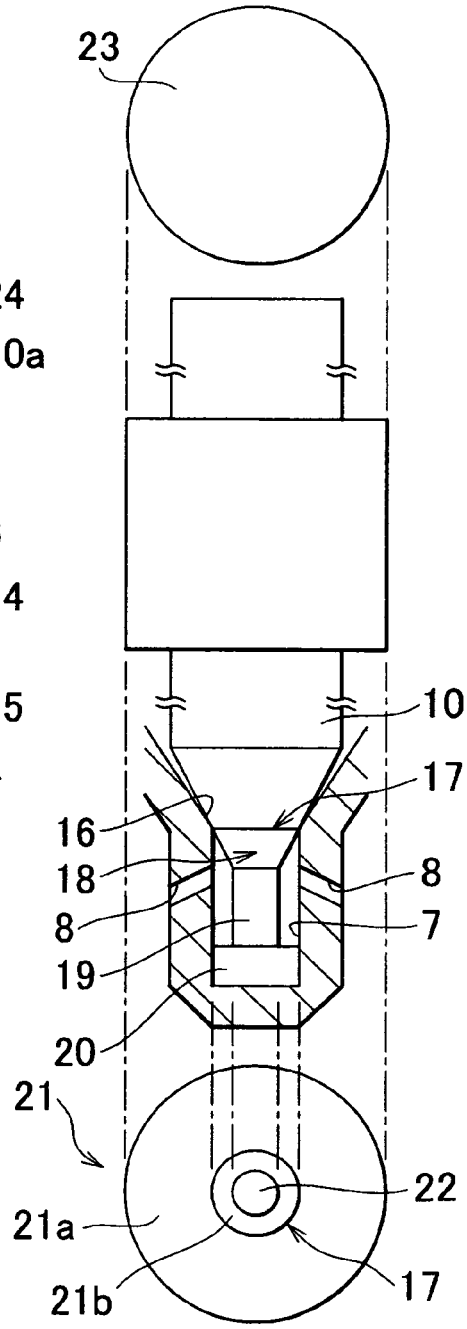

FIG. 1A and FIG. 1B are diagrams each showing a first embodiment of the invention. As shown in FIG. 1A and FIG. 1B, a fuel injection valve 1 includes a housing 2. The housing 2 includes a nozzle holder 3, and a casing 4 fixed to the nozzle holder 3.

In the housing 2, a nozzle chamber 5 and a coil chamber 6 are defined. A cylindrical sack 7 is formed in a nozzle holder 3 positioned at a bottom end of the nozzle chamber 5. A nozzle or a nozzle portion 8 is provided in a peripheral surface of the sack 7. A slide portion 9 is formed in the nozzle holder 3 positioned at a top end of the nozzle chamber 5. The nozzle chamber 5 is connected to the coil chamber 6 through the slide portion 9. The needle 10 extends in the direction of a longitudinal axis K from the nozzle chamber 5 to the coil chamber 6 through the slide portion 9. Also, the needle 10 is supported in the slide portion 9 so as to be slidable in the direction of the longitudinal axis K.

Meanwhile, an annular fixed core 12 including a solenoid coil 11 is fixed in the coil chamber 6. An armature 13 is integrally formed on the needle 10 at a portion positioned in the coil chamber 6 such that the armature 13 is opposed to the solenoid coil 11.

The coil chamber 6 is connected to a pressurized fuel source, for example, a common rail (not shown) through a fuel port 14 formed in the casing 4. Also, the nozzle chamber 5 is connected to the coil chamber 6 through a pressurized fuel supply passage 15 formed in the nozzle holder 3. Thus, the nozzle chamber 5 is connected to the pressurized fuel source. As a result, each of the nozzle chamber 5 and the coil chamber 6 is filled with the pressurized fuel.

As apparent form FIG. 1B, a needle seat 16 is formed in an inner wall surface of the nozzle holder 3 adjacent to the sack 7. When the needle 10 is seated at the needle seat 16, an annular seal 17 is formed between the needle 10 and the needle seat 16. A bottom portion side extending portion 19 is formed integrally with the needle 10 at a needle bottom surface inner portion 18 which is a portion of a bottom surface of the needle 10 on an inner side of the annular seal 17. The bottom portion side extending portion 19 extends in the longitudinal direction K—K from the needle bottom surface inner portion 18 into the sack 7 beyond the nozzle chamber 5. In this case, an enlarged head portion 20 which is formed at the bottom end of the bottom portion side extending portion 19 is slidably housed in the sack 7.

As shown in a projection plane at the bottom portion side of FIG. 1B, a downward pressure receiving surface 21 is formed in the needle 10 at a portion positioned in the nozzle chamber 5. The downward pressure receiving surface 21 includes a downward pressure receiving surface outer portion 21*a* and a downward pressure receiving surface inner portion 21*b*. The downward pressure receiving surface outer portion 21*a* is an annular portion on a radially outer side of the annular seal 17. The downward pressure receiving inner portion 21*b* is an annular portion on an inner side of the downward pressure receiving surface outer portion 21*a* and the annular seal 17. In this case, an area of the downward pressure receiving surface inner portion 21*b* is smaller than an area of the needle bottom surface inner portion 18 by a cross sectional area 22 of the bottom portion side extending portion 19. Meanwhile, an upward pressure receiving surface 23 is formed in the needle 10 at a portion positioned in the coil chamber 6. This is also shown as a projection plane at a top portion of FIG. 1B.

Referring to FIG. 1A again, a compression spring 24 which applies force to the needle 10 in a valve closing direction is inserted between a top surface 10*a* of the needle 10 and an inner wall surface of the casing 4 opposed to the top surface 10*a*.

Next, description will be made of operation of the fuel injection valve 1 according to the first embodiment of the invention.

Each of FIG. 1A and FIG. 1B shows the fuel injection valve 1 when closed. In this case, the solenoid coil 11 is de-energized. The needle 10 remains seated at the needle seat 16, whereby fuel injection is stopped.

Figure 2:
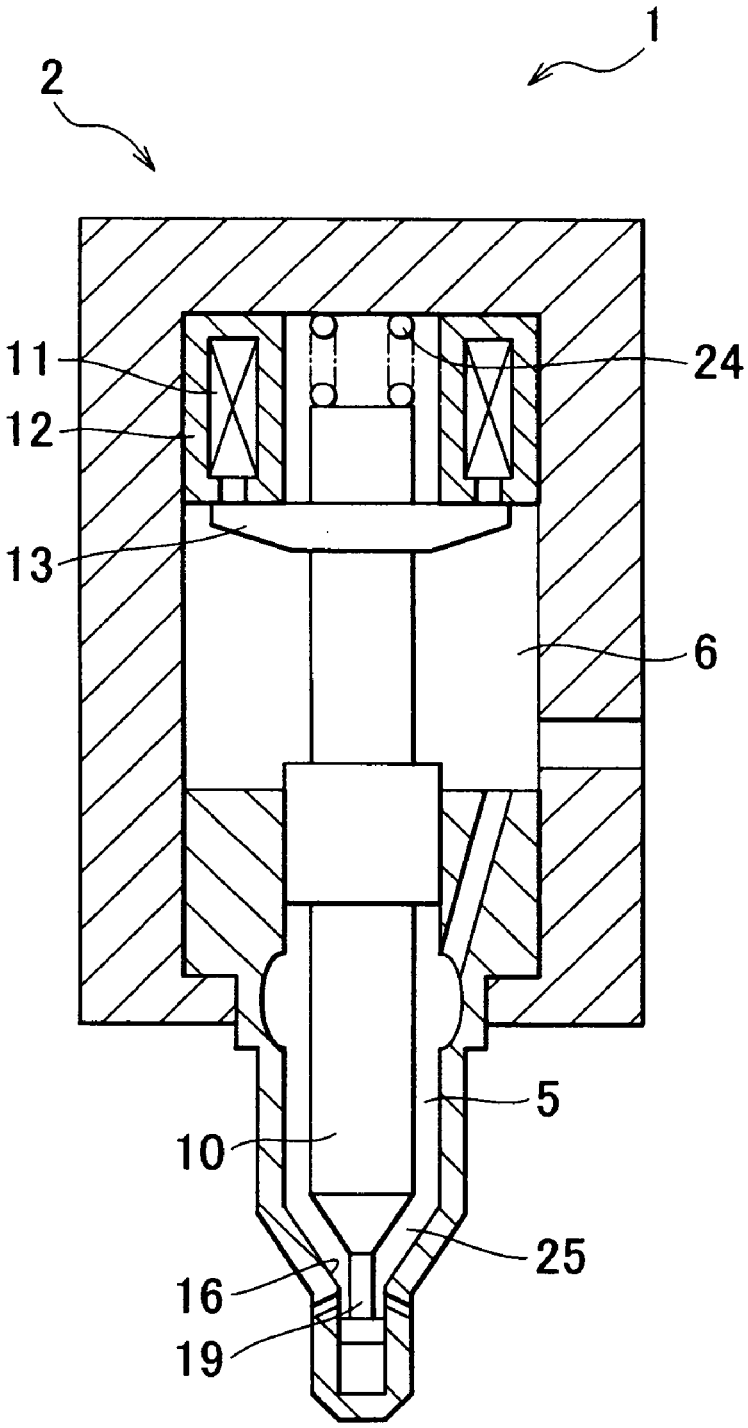
FIG. 2 is a diagram showing the fuel injection valve according to the first embodiment of the invention when opened.

Subsequently, when the fuel injection should be started, the solenoid coil 11 is energized. As a result, upward magnetic attraction force of the solenoid coil 11 is applied to the needle 10, and the needle 10 is displaced upward, and is separated from the needle seat 16. Then, the fuel injection is started. Subsequently, when the armature 13 hits a bottom end surface of the fixed core 12 as shown in FIG. 2, upward displacement of the needle 10 is restricted, and the needle 10 is maintained at a position shown in FIG. 2. When the needle 10 is separated from the needle seat 16 in this manner, an annular fuel passage 25 is formed between the needle 10 and the needle seat 16, and fuel flows through the fuel passage 25.

Subsequently, when the fuel injection should be stopped, the solenoid coil 11 is de-energized. As a result, the needle 10 is displaced downward by the spring force of the compression spring 24. Subsequently, when the needle 10 is seated at the needle seat 16 as shown in FIG. 1A and FIG. 1B, the fuel injection is stopped.

Figure 3A:
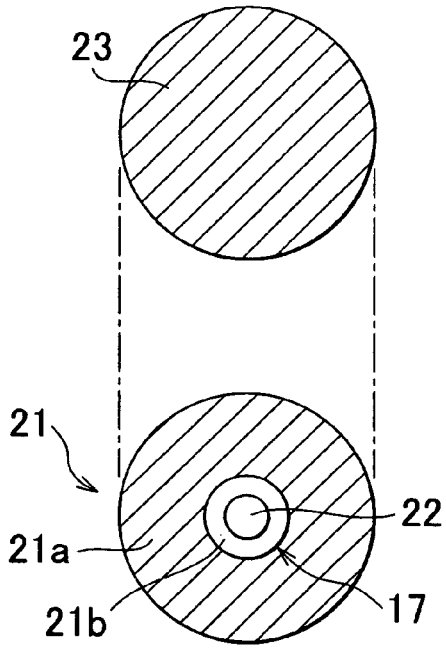
FIG. 3A and FIG. 3B are diagrams each explaining the first embodiment of the invention.

When the fuel injection is stopped as shown in FIG. 1A and FIG. 1B, downward pressure of pressurized fuel is applied to the upward pressure receiving surface 23, upward pressure of pressurized fuel is applied to the downward pressure receiving surface outer portion 21*a*, and pressure of pressurized fuel is not applied to the downward pressure receiving surface inner portion 21*b*, as shown by hatching in FIG. 3A. Subsequently, when the solenoid coil 11 is energized, upward magnetic attraction force is applied to the needle 10. Accordingly, in this case, the solenoid coil 11 is required to supply magnetic attraction force such that the needle 10 is separated from the needle seat 16 by the upward magnetic attraction force of the solenoid coil 11 and the upward force applied to the downward pressure receiving surface outer portion 21*a*, against the downward force applied to the upward pressure receiving surface 23 and downward spring force of the compression spring 24.

Figure 3B:
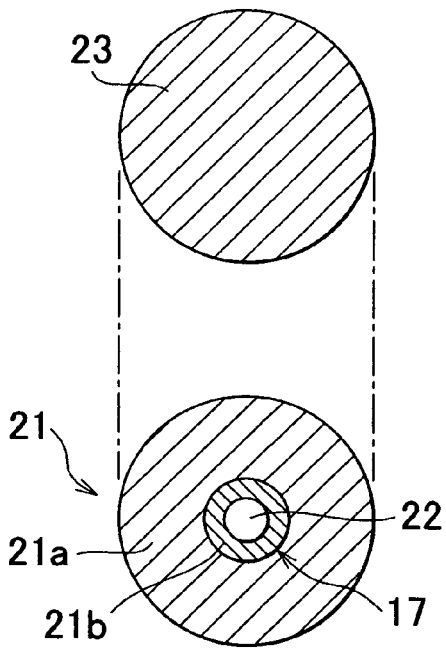

When the needle 10 is separated from the needle seat 16, the upward pressure of the pressurized fuel is applied not only to the downward pressure receiving surface 21*a* but also to the downward pressure receiving surface inner portion 21*b*, as shown by hatching in FIG. 3B. Subsequently, when the solenoid coil 11 is de-energized, the upward magnetic attraction force is no longer applied to the needle 10. Accordingly, in this case, the compression spring 24 is required to supply the spring force such that the needle 10 is displaced downward to the needle seat 16 by the downward force applied to the upward pressure receiving surface 23 and the downward spring force of the compression spring 24, against the upward force applied to the downward pressure receiving surface outer portion 21*a* and the upward force applied to the downward pressure receiving surface inner portion 21*b*.

Thus, in the first embodiment of the invention, when the needle 10 is separated from the needle seat 16, an area of the pressure receiving surface to which the upward pressure of the pressurized fuel is applied is increased by an area of the downward pressure receiving surface inner portion 21*b*, as compared to when the needle 10 is seated at the needle seat 16. However, this increased area is decreased by the cross sectional area 22 of the bottom portion side extending portion 19, as compared to a conventional case that has described with reference to FIG. 11A, FIG. 11B, FIG. 12A, and FIG. 12B. Therefore, the required spring force of the compression spring 24 can be reduced, and accordingly the required driving force of the solenoid coil 11 can be reduced. As a result, an amount of energy consumed by the solenoid coil 11 can be reduced, or size of the solenoid coil 11 can be reduced.

Figure 4A:
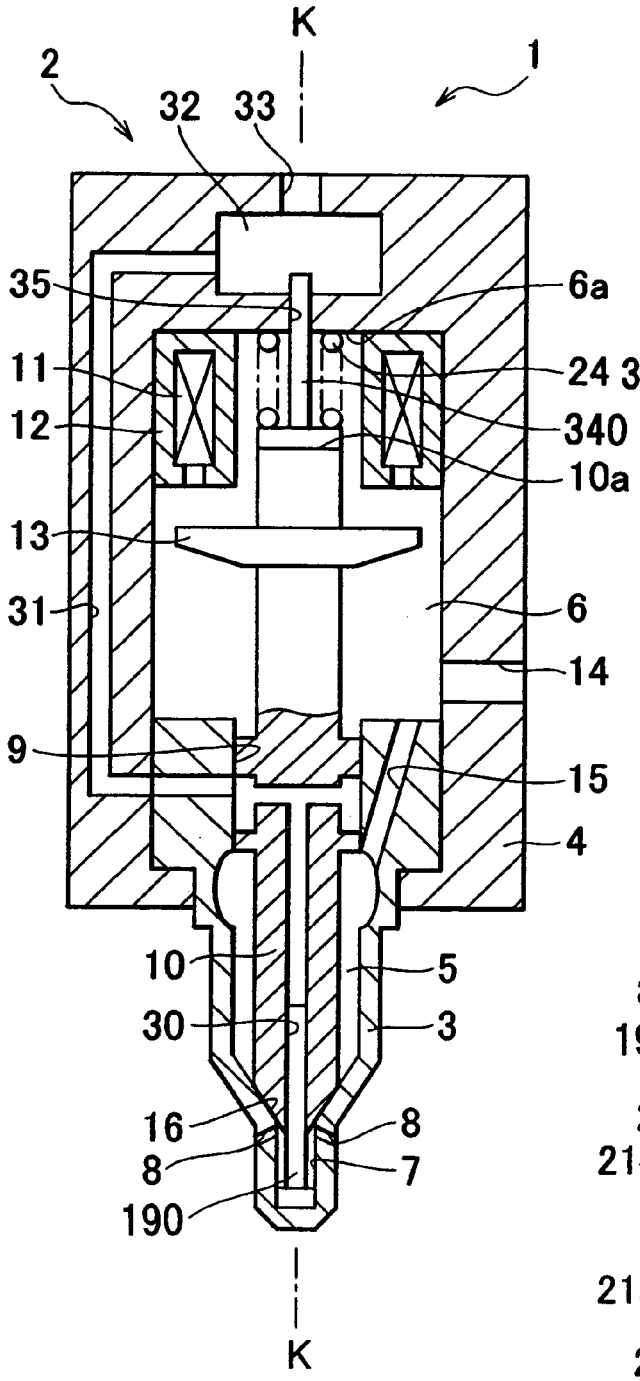
FIG. 4A and FIG. 4B are diagrams each showing a fuel injection valve according to a second embodiment of the invention when closed.
Figure 4B:
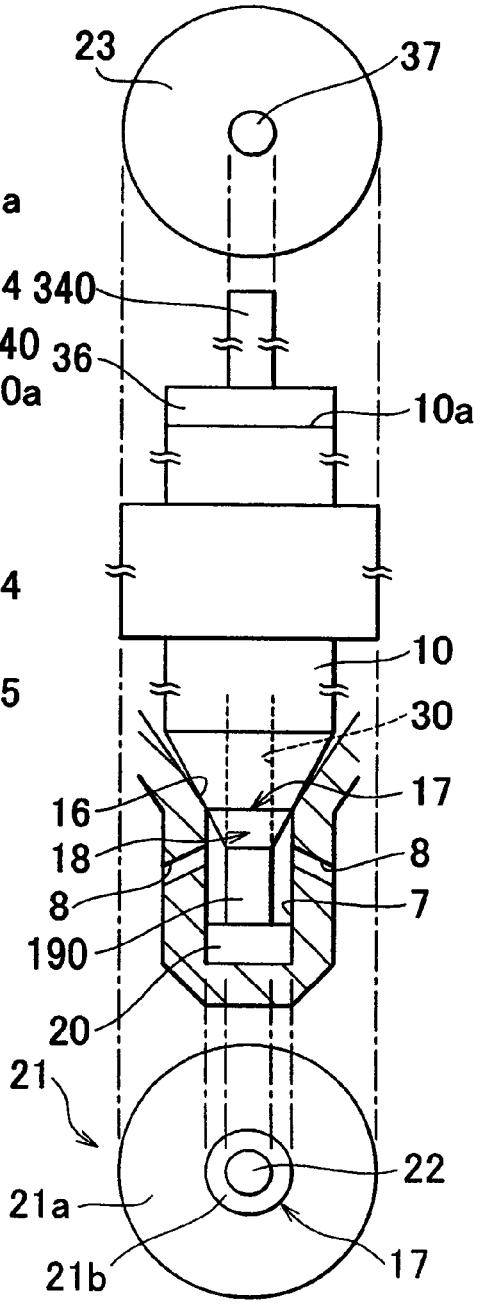

Each of FIG. 4A and FIG. 4B shows a second embodiment of the invention.

In the second embodiment of the invention, the bottom portion side extending portion 19 that has been described in the first embodiment is constituted by a bottom portion side bar-shaped member 190 that is formed separately from the needle 10. Meanwhile, a bottom portion side receiving portion 30 is formed in the needle 10. The bottom portion side receiving portion 30 extends in the direction of the longitudinal axis K—K, and opens at the needle bottom surface inner portion 18. The bottom portion side bar-shaped member 190 is slidably and hermetically housed in the bottom portion side receiving portion 30. Also, the enlarged head portion 20 formed at the bottom end of the bottom portion side bar-shaped member 190 is positioned at an end portion of the sack 7. The enlarged head portion 20 may be fixed to the sack 7. Alternatively, the enlarged head portion 20 may be movable with respect to the sack 7.

In the aforementioned first embodiment, a center axis of the needle 10 needs to match a center axis of the bottom portion side extending portion 19 with high accuracy, in order to smoothly slide the needle 10 with respect to the slide portion 9 and the sack 7. However, if the bottom portion side extending portion 19 is formed integrally with the needle 10, it is difficult to match the center axes thereof. Accordingly, in the second embodiment of the invention, since the bottom portion side bar-shaped member 190 that is formed separately from the needle 10 is used as the bottom portion side extending portion 19, the fuel injection valve 1 can be produced easily. Also, the operation of the needle 10 can be made stable by this bottom portion side bar-shaped member 190 when the needle 10 is separated from the needle seat 16.

Further, as shown in FIG. 4A and FIG. 4B, the bottom portion side receiving portion 30 extends in the needle 10 from the bottom surface inner portion 18, and opens at the outer surface of the needle 10 which is opposed to an inner wall surface of the slide portion 9. Meanwhile, a fuel escape passage 31 is formed in the housing 2. The fuel escape passage 31 opens at the inner wall surface of the slide portion 9 at one end, whereby the bottom portion side receiving portion 30 is connected to the fuel escape passage 31 on a side opposite to the needle bottom surface inner portion 18. The fuel escape passage 31 extends in the housing 2, and is connected to an escape fuel chamber 32 formed in the housing 2. The escape fuel chamber 32 is connected, through a fuel escape port 33, to a component other than the fuel injection valve 1, such as a fuel tank.

Further, in the second embodiment of the invention, a top portion side extending portion 34 which extends from the top surface 10*a* of the needle to an inner wall surface 6*a* of the coil chamber 6 is formed. The top portion side extending portion 34 is constituted by a top portion side bar-shaped member 340 that is formed separately from the needle 10, as well as the bottom portion side extending portion 19. Meanwhile, a top portion side receiving portion 35 is formed in the casing 4. The top portion side receiving portion 35 extends in the direction of the longitudinal axis K—K from the inner wall surface 6*a* of the coil chamber that is opposed to the needle top surface 10*a* to the escape fuel chamber 32. The top portion side bar-shaped member 340 is slidably and hermetically housed in the top portion side receiving portion 35. An enlarged head portion 36 is formed at a bottom end of the top portion side bar-shaped member 340. The enlarged head portion 36 is pressed against the needle top portion 10*a* by the compression spring 24, and is fixed on the needle top portion 10*a*. The top portion side extending portion 34 may be formed integrally with the needle 10.

Particularly, as apparent from FIG. 4B, the upward pressure receiving surface 23 in this case becomes annular due to a cross sectional area 37 of the top portion side bar-shaped member 340. In the second embodiment of the invention, the cross sectional area 37 of the top portion side bar-shaped member 340 is set such that a sum of the cross sectional area of the downward pressure receiving surface outer portion 21*a* and the cross sectional area of the downward pressure receiving surface inner portion 21*b* is substantially equal to the cross sectional area of the upward pressure receiving surface 23. That is, in the second embodiment of the invention, a diameter of the bottom portion side bar-shaped member 190 is substantially equal to a diameter of the top portion side bar-shaped member 340.

The fuel that passes through a clearance between the bottom portion side receiving portion 30 and the bottom portion side bar-shaped member 190, and a clearance between the top portion side receiving portion 35 and the top portion side bar-shaped member 340 reaches the escape fuel chamber 32. Then, the fuel is returned to the fuel tank through the fuel escape port 33.

Figure 5:
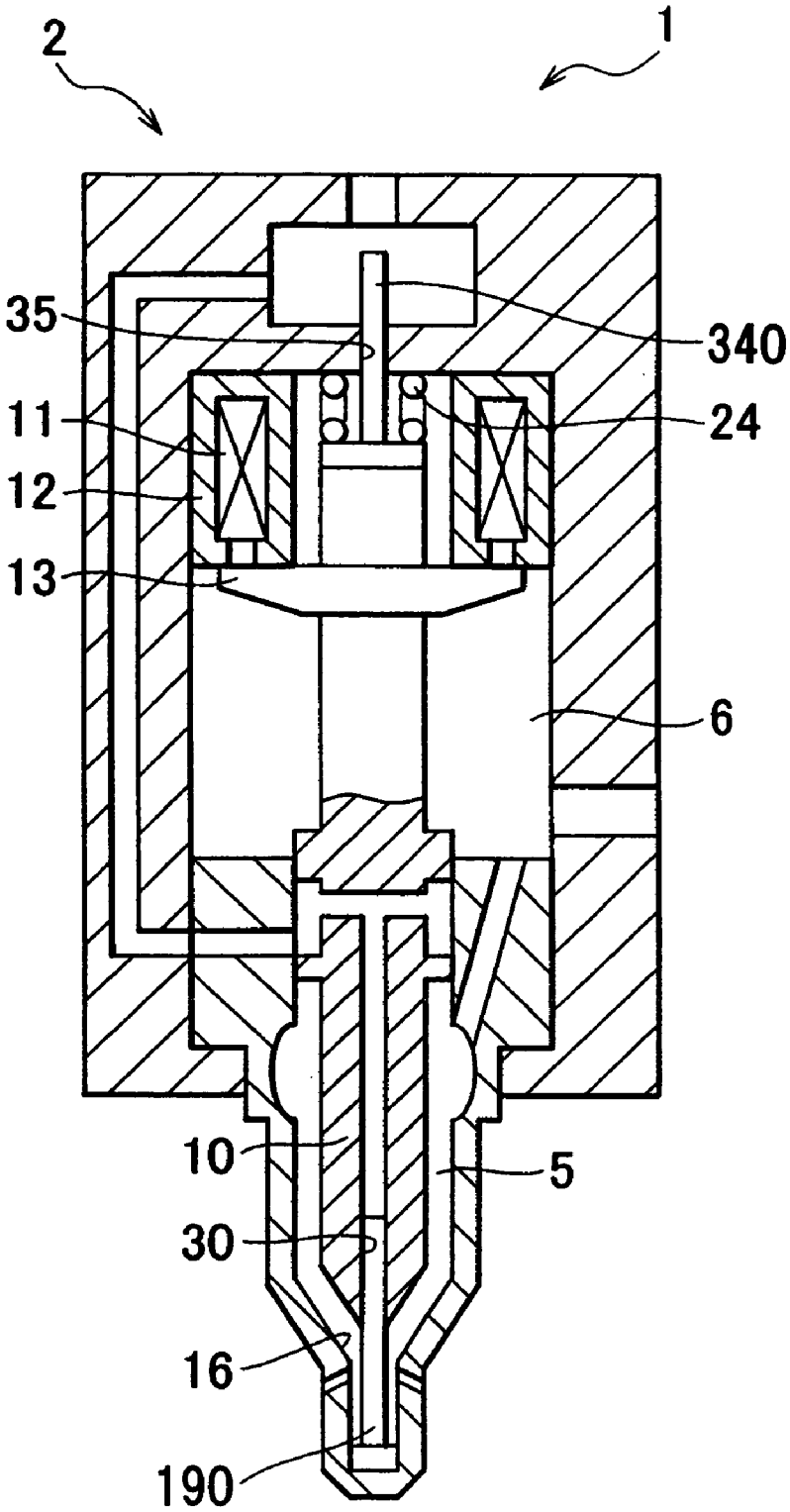
FIG. 5 is a diagram showing the fuel injection valve according to the second embodiment of the invention when opened.

Each of FIG. 4A and FIG. 4B shows the fuel injection valve 1 when closed. In this case, the needle 10 remains seated at the needle seat 16. Subsequently, when the solenoid coil 11 is energized so as to start the fuel injection, the upward magnetic attraction force of the solenoid coil 11 is applied to the needle 10, the needle 10 is displaced upward, and the needle 10 is separated from the needle seat 16. Subsequently, when the armature 13 hits the bottom end surface of the fixed core 12 as shown in FIG. 5, the upward displacement of the needle 10 is restricted. Subsequently, when the solenoid coil 11 is de-energized so as to stop the fuel injection, the needle 10 is displaced downward by the spring force of the compression spring 24. Then, the needle 10 is seated at the needle seat 16 as shown in FIG. 4A and FIG. 4B.

Figure 6A:
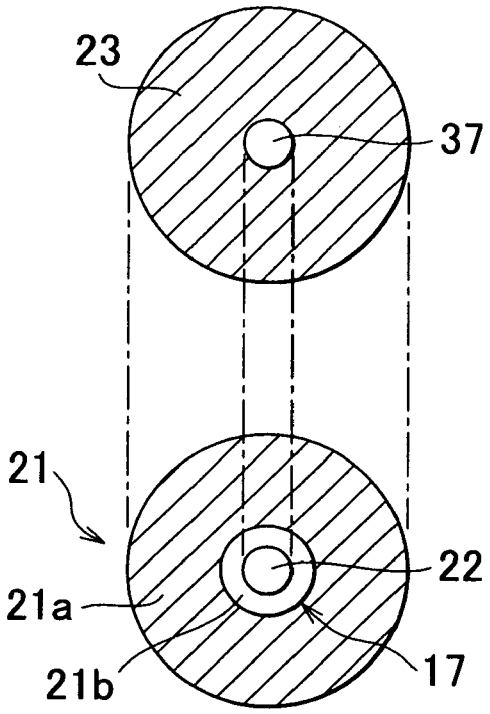
FIG. 6A and FIG. 6B are diagrams each explaining the second embodiment of the invention.
Figure 6B:
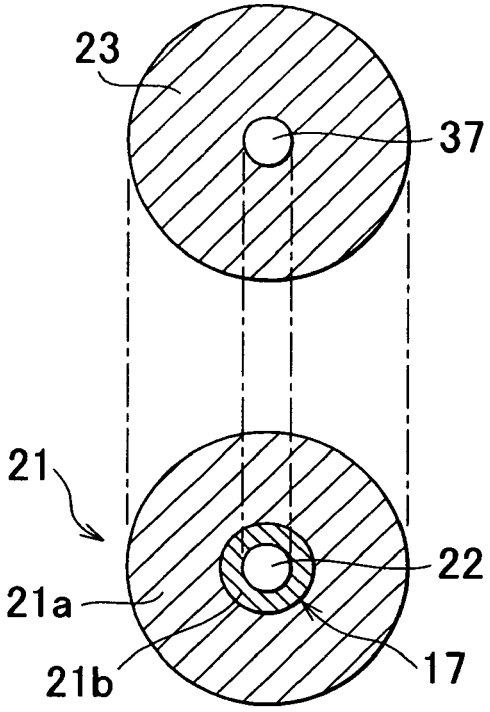

When the fuel injection is stopped as shown in FIG. 4A and FIG. 4B, the downward pressure of the pressurized fuel is applied to the upward pressure receiving surface 23, the upward pressure of the pressurized fuel is applied to the downward pressure receiving surface outer portion 21*a*, and the pressure of the pressurized fuel is not applied to the downward pressure receiving surface inner portion 21*b*, as shown by hatching in FIG. 6A. Subsequently, when the needle 10 is separated from the needle seat 16, the upward pressure of the pressurized fuel is applied not only to the downward pressure receiving surface outer portion 21*a*, but also to the downward pressure receiving surface inner portion 21*b*.

In this case, in the second embodiment of the invention, the sum of the cross sectional area of the downward pressure receiving surface outer portion 21*a* and the cross sectional area of the downward pressure receiving surface inner portion 21*b* is substantially equal to the cross sectional area of the upward pressure receiving surface 23. Accordingly, when the needle 10 is separated from the needle seat 16, the downward pressure of the pressurized fuel applied to the needle 10 and the upward pressure of the pressurized fuel applied to the needle 10 can be balanced with each other. Thus, when the needle 10 is separated from the needle seat 16, the pressure of the pressurized fuel applied to the needle 10 does not need to be considered. Accordingly, as the magnetic attraction force of the solenoid coil 11 necessary for raising the needle 10, only the magnetic attraction force that can overcome the spring force of the compression spring 24 is required. Since other configurations and effects in the second embodiment of the invention are the same as in the first embodiment of the invention, description thereof will be omitted.

Figure 7:
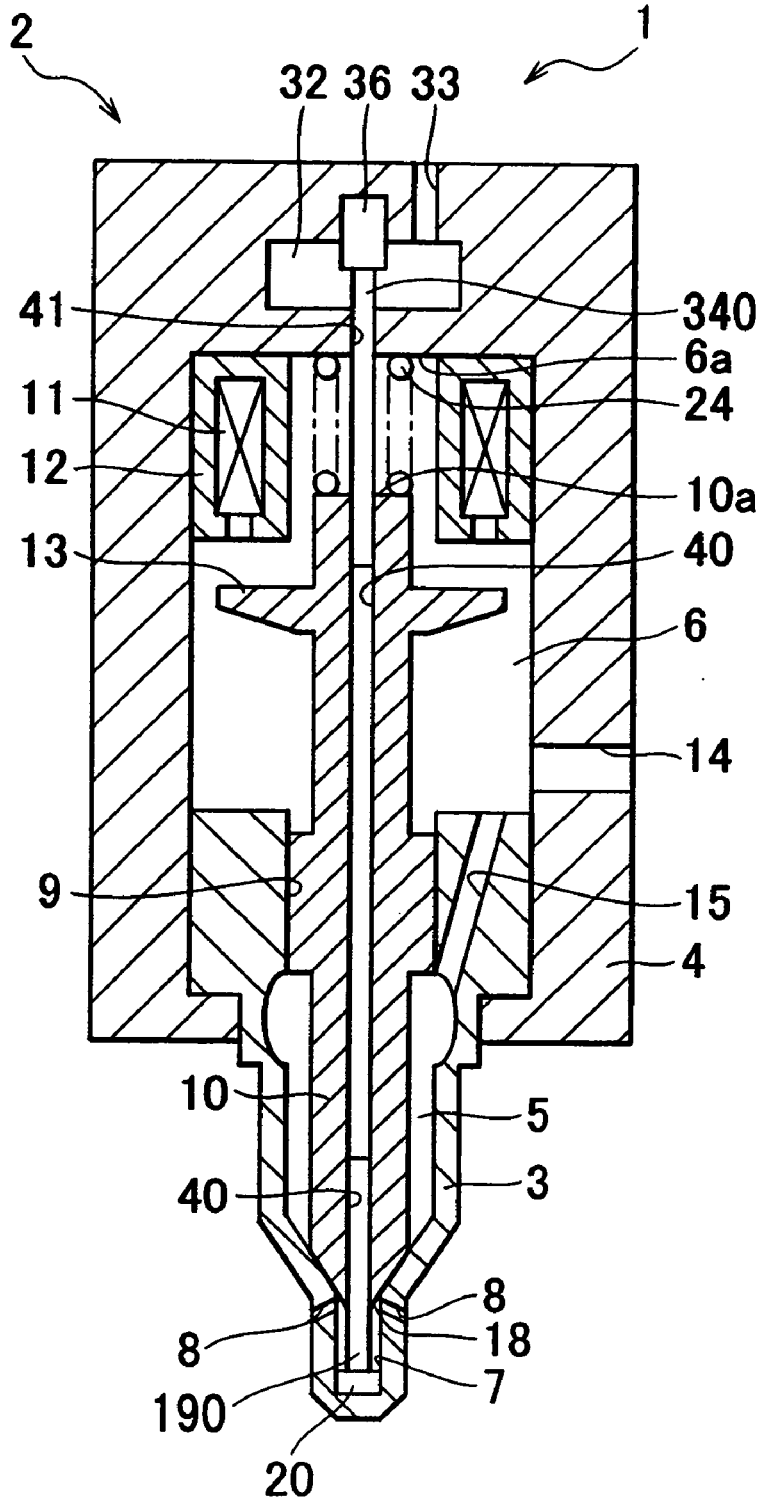
FIG. 7 is a longitudinal sectional view showing a fuel injection valve according to a third embodiment of the invention.

FIG. 7 shows a third embodiment of the invention.

In the third embodiment as well, the bottom portion side extending portion 19 that has been described in the first embodiment is constituted by the bottom portion side bar-shaped member 190 that is formed separately from the needle 10, and the enlarged head portion 20 is positioned in the end portion of the sack 7, as in the second embodiment. Meanwhile, a through portion 40 is formed in the needle 10. The through portion 40 extends through the needle 10 in the direction of the longitudinal axis K—K from the needle bottom surface inner portion 18 to the needle top surface 10*a*. The through portion 40 includes the bottom portion side receiving portion 30 at a bottom portion side. The bottom portion side bar-shaped member 190 is slidably and hermetically housed in the bottom portion side receiving portion 30.

The top portion side extending portion 34 is constituted by a top portion side bar-shaped member 340 that is formed separately from the needle 10. However, a top end of the top portion side bar-shaped member 340 is fixed to the casing 4 which defines the coil chamber 6. More specifically, the top portion side bar-shaped member 340 is fixed to the casing 4 at the enlarged head portion 36 that is formed at the top portion of the top portion side bar-shaped member 340. The top portion side bar-shaped member 340 extends from the enlarged head portion 36 into the coil chamber 6 through the escape fuel chamber 32 and a through portion 41. The through portion 40 includes a top portion side receiving portion 42 at a top portion side. The top portion side bar-shaped member 340 is slidably and hermetically housed in the top portion side receiving portion 42. The top portion side bar-shaped member 340 is hermetically supported in the through portion 41.

Accordingly, the top portion side receiving portion 42 is formed in the needle 10. The top portion side receiving portion 42 extends in the direction of the longitudinal axis K—K, and opens at the top surface 10*a* of the needle. The top portion side bar-shaped member 340 is slidably housed in the top portion side receiving portion 42. Also, the top end of the top portion side bar-shaped member 340 is fixed to the housing 2 which defines the coil chamber 6. In addition, in the third embodiment of the invention, both of the top portion side receiving portion 42 and the bottom portion side receiving portion 30 are constituted by the through portion 40.

In this case, after fuel passes through a clearance between the through portion 40 constituting the bottom portion side receiving portion 30 and the bottom portion side extending portion 19, the fuel passes through a clearance between the through portion 40 and the top portion side bar-shaped member 340. Then, the fuel reaches the coil chamber 6. The fuel in the coil chamber 6 passes through a clearance between the through portion 41 and the top portion side bar-shaped member 340, and reaches the escape fuel chamber 32. Accordingly, it is not necessary to provide the fuel escape passage that should be connected to the through portion 40. Therefore, the configuration of the fuel injection valve 1 can be simplified, and size thereof can be reduced. Since other configurations and effects in the third embodiment of the invention are the same as in the first and second embodiments of the invention, description thereof will be omitted.

Figure 8A:
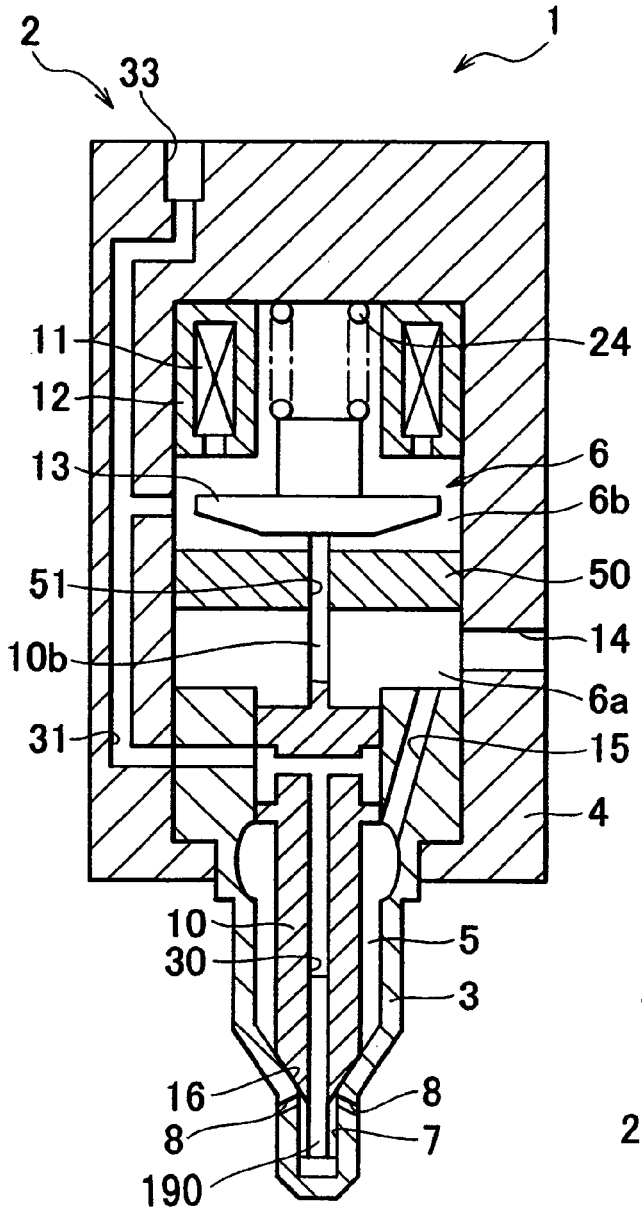
FIG. 8A and FIG. 8B are diagrams each showing a fuel injection valve according to a fourth embodiment of the invention when closed.
Figure 8B:
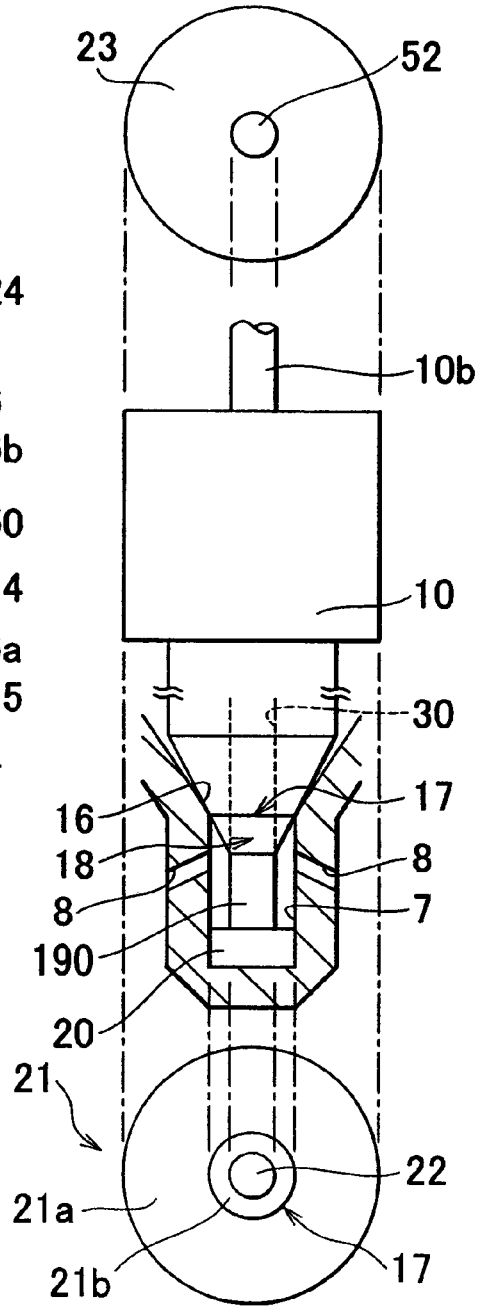

Each of FIG. 8A and FIG. 8B shows a fourth embodiment of the invention.

In the fourth embodiment of the invention, the coil chamber 6 is divided into a high pressure chamber 6*a* and a low pressure chamber 6*b* by a partition wall 50. A slide portion 51 is formed in the partition wall 50. Meanwhile, a small-diameter portion 10*b* is formed at an intermediate portion of the needle 10. The small-diameter portion 10*b* extends through the slide portion 51, whereby the needle 10 extends from the high pressure chamber 6*a* to the low pressure chamber 6*b*. In this case, the needle 10 is hermetically supported in the slide portion 51 so as to be slidable in the direction of the longitudinal axis K—K. Also, the diameter of the small-diameter portion 10*b* is set such that a cross sectional area of the small-diameter portion 10*b* becomes substantially equal to the cross sectional area of the bottom portion side bar-shaped member 190.

The pressurized fuel source is connected to the high pressure chamber 6*a* through a fuel board 14, whereby the high pressure chamber 6*a* is filled with the pressurized fuel. Meanwhile, the low pressure chamber 6*b* is connected to the fuel escape passage 31, and thus the low pressure chamber 6*b* is not filled with the pressurized fuel. In the fourth embodiment of the invention, the solenoid coil 11 is positioned in the low pressure chamber 6*b*. As a result, a mechanical load applied to the solenoid coil 11 can be reduced. The armature 13 of the needle 10 is positioned in the low pressure chamber 6*b*.

Particularly, as apparent from FIG. 8B, in the fourth embodiment of the invention, the upward pressure receiving surface 23 is formed in the needle 10 at a portion positioned in the high pressure chamber 6*a*. In this case, the upward pressure receiving surface 23 becomes annular due to a cross sectional area 52 of the small-diameter portion 10*b*. The cross sectional area 52 of the small-diameter portion 10*b* is substantially equal to the cross sectional area 22 of the bottom portion side bar-shaped member 190. Accordingly, when the needle 10 is separated from the needle seat 16, the area of the downward pressure receiving surface 21 to which the pressure of the pressurized fuel is applied is substantially equal to the area of the upward pressure receiving surface 23, as in the second and third embodiments of the invention. As a result, the downward pressure of the pressurized fuel applied to the needle 10 and the upward pressure of the pressurized fuel applied to the needle 10 are balanced with each other.

Since other configurations and effects in the fourth embodiment of the invention are the same as in the first to third embodiments that have been described so far, description thereof will be omitted.

FIG. 9 shows a fifth embodiment of the invention.

In the aforementioned fourth embodiment, in order to balance the downward pressure of the pressurized fuel applied to the needle 10 and the upward pressure of the pressurized fuel applied to the needle 10 with each other, the small-diameter portion 10*b* is provided in the needle 10. However, durability and reliability of the needle 10 may be decreased due to the small-diameter portion 10*b*.

Accordingly, in the fifth embodiment of the invention, an outline or a contour of the needle 10 is substantially the same as in the first to the fourth embodiments, and the downward pressure of the pressurized fuel applied to the needle 10 and the upward pressure of the pressurized fuel applied to the needle 10 are balanced with each other when the needle 10 is separated from the needle seat 16. That is, first, as in the first to fourth embodiments, a first pressure receiving surface 23*a* is constituted by a shoulder portion 10*c* of the needle 10 positioned in the high pressure chamber 6*a*, as shown in FIG. 9B.

Further, a concave groove 60 is formed inside the needle 10. The concave groove 60 extends in the direction of the longitudinal axis K—K, and opens at the top surface 10*a* of the needle. A plug member 61 that is fixed to the casing 4 is slidably and hermitically inserted in the concave groove 60. Also, the concave groove 60 is connected to the high pressure chamber 6*a* through a communication portion 62. The communication portion 62 is formed in an outer surface of the needle 10 at a portion which is positioned in the high pressure chamber 6*a*, and which does not constitute the pressure receiving surface. As a result, the concave groove 60 is filled with the pressurized fuel. Therefore, a bottom surface 63 of the concave groove 60 constitutes a second upward pressure receiving surface 23*b*, as shown in FIG. 9B. Thus, in the fifth embodiment of the invention, the upward pressure receiving surface 23 includes the first upward pressure receiving surface 23*a* and the second upward pressure receiving surface 23*b*.

In addition, an internal diameter of the concave groove 60 is set such that a sum of an area of the first upward pressure receiving surface 23*a* and an area of the second upward pressure receiving surface 23*b* is substantially equal to a sum of an area of the downward pressure receiving surface outer portion 21*a* and an area of the downward pressure receiving surface inner portion 21*b*. In other words, a cross sectional area of an annular intermediate portion of the needle, which is formed by forming the concave groove 60, is substantially equal to the cross sectional area 22 of the bottom portion side extending member 19. That is, in this embodiment, the cross sectional area of the needle at a portion which extends through the partition wall 50 is substantially equal to the cross sectional area 22 of the bottom portion side extending member 19.

Figure 9A:
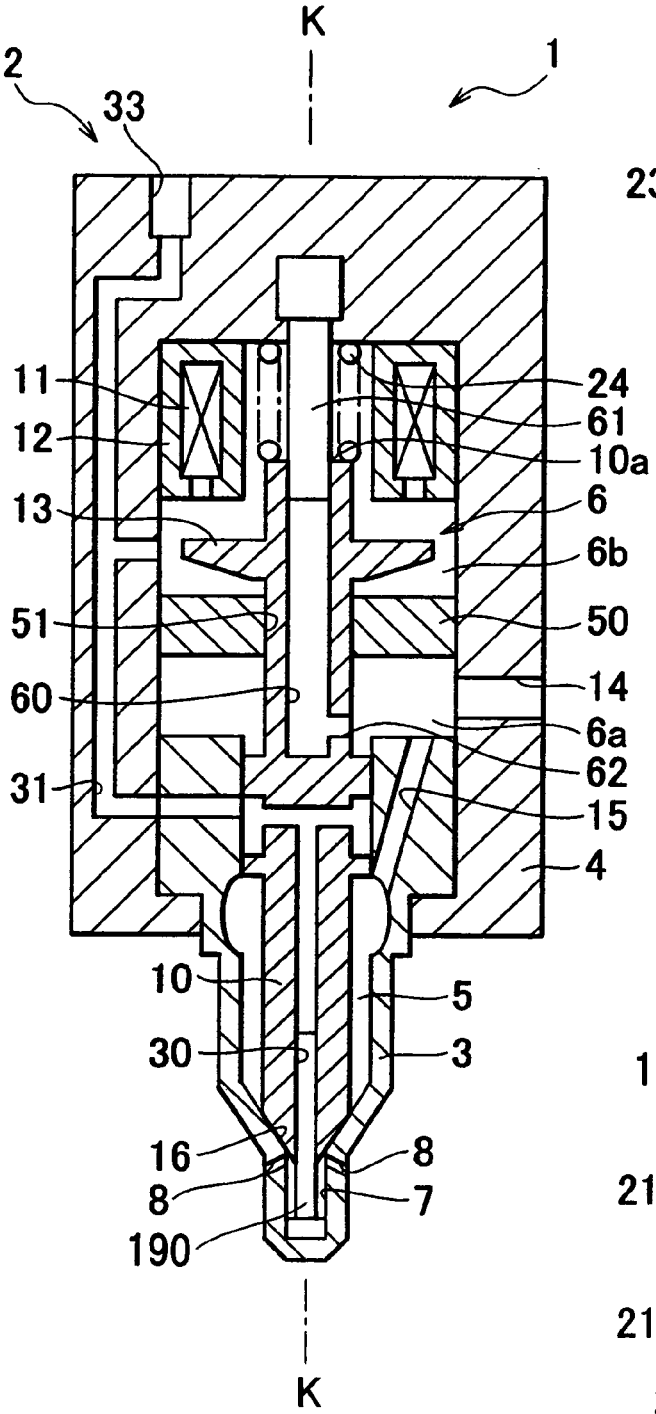
FIG. 9A and FIG. 9B are diagrams each showing a fuel injection valve according to a fifth embodiment of the invention when closed.
Figure 9B:
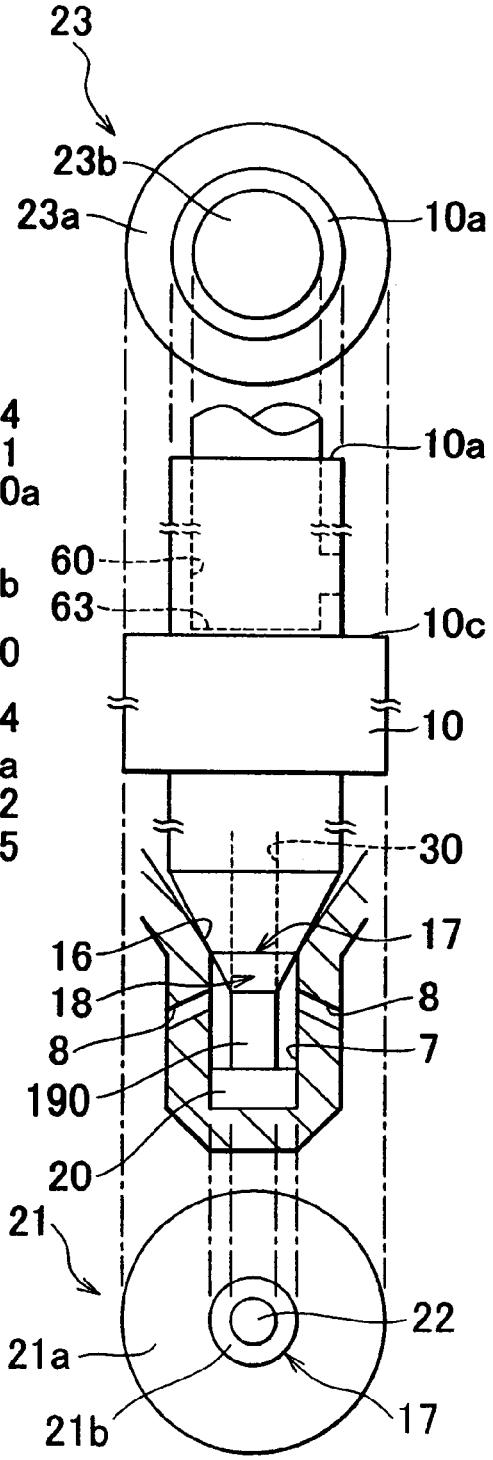
Figure 10A:
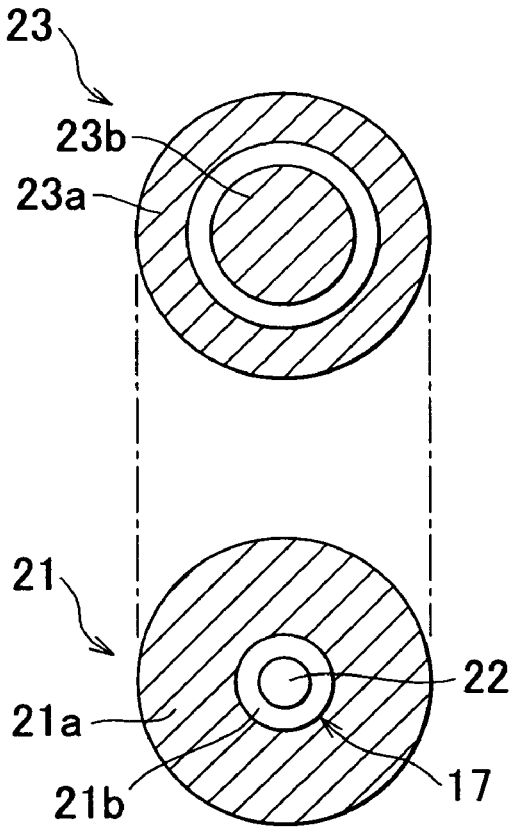
FIG. 10A and FIG. 10B are diagrams each explaining the fifth embodiment of the invention.
Figure 10B:
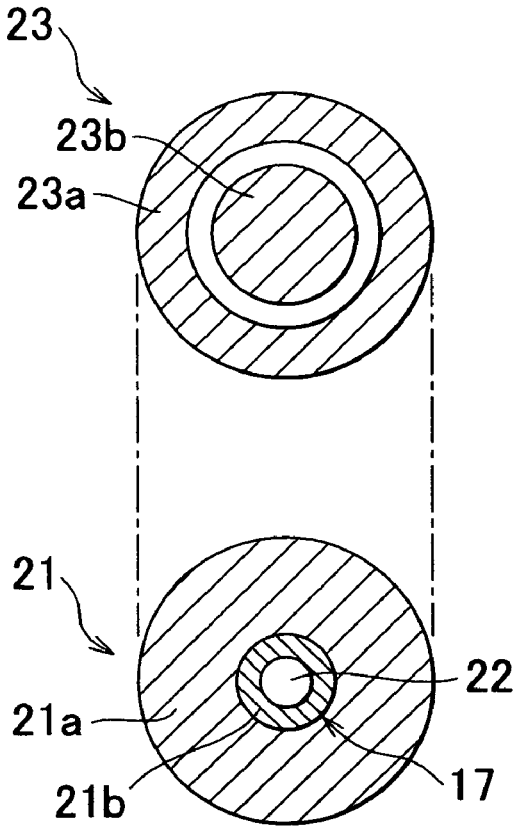
Figure 11A:
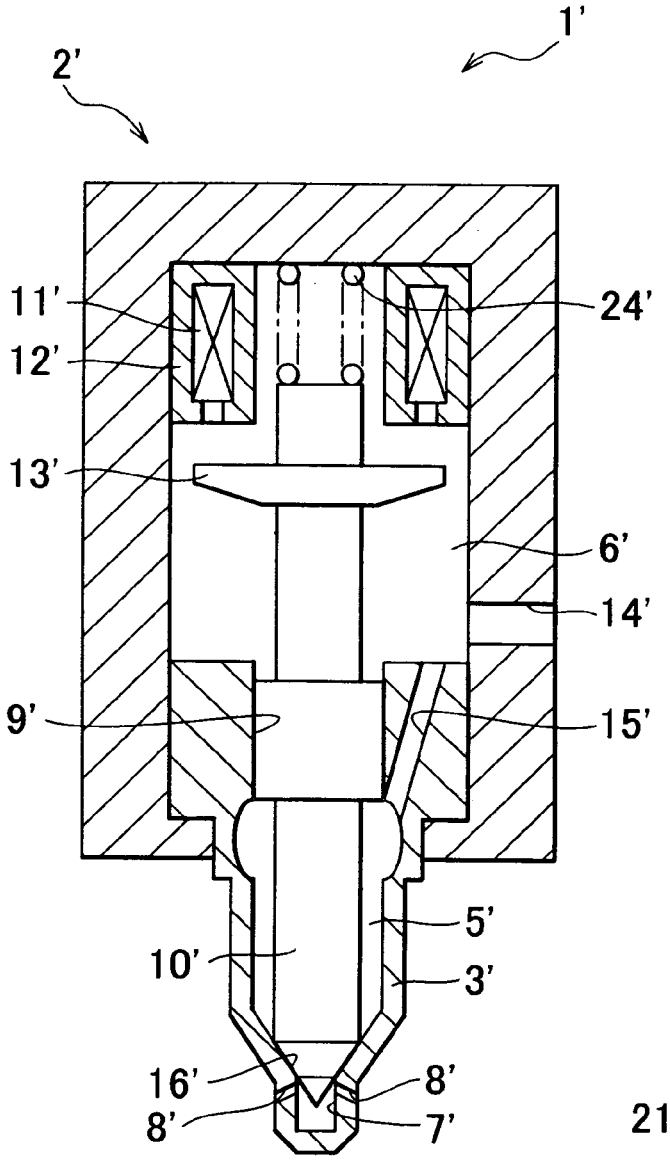
RELATED ART FIG. 11A
FIG. 11A and FIG. 11B are diagrams each showing a fuel injection valve according to related art when closed.
Figure 11B:
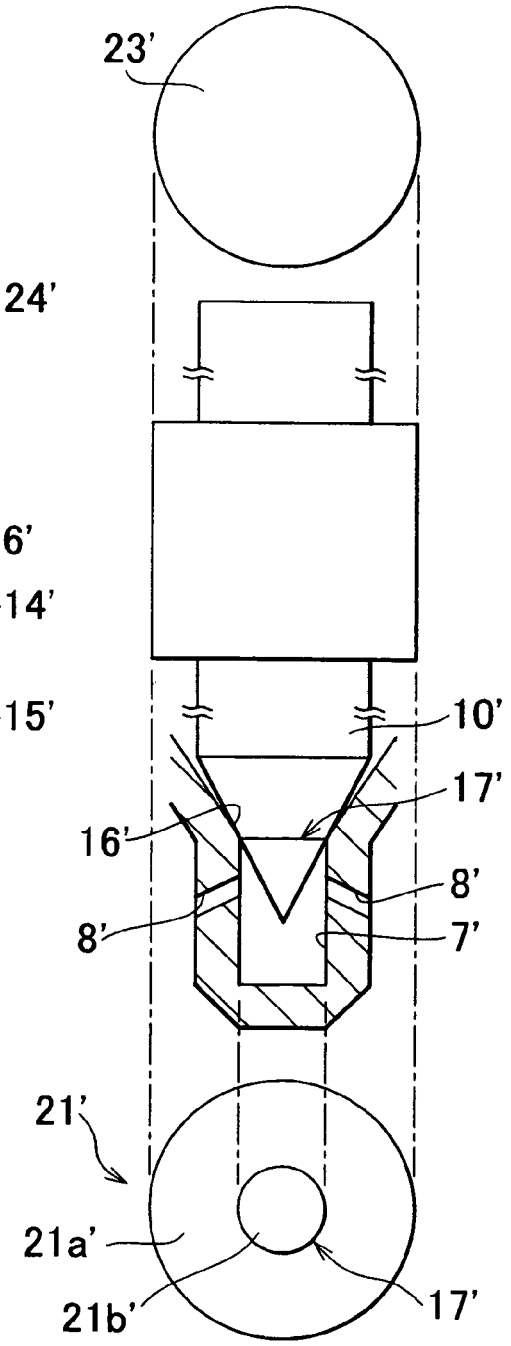
RELATED ART FIG. 11B
Figure 12A:
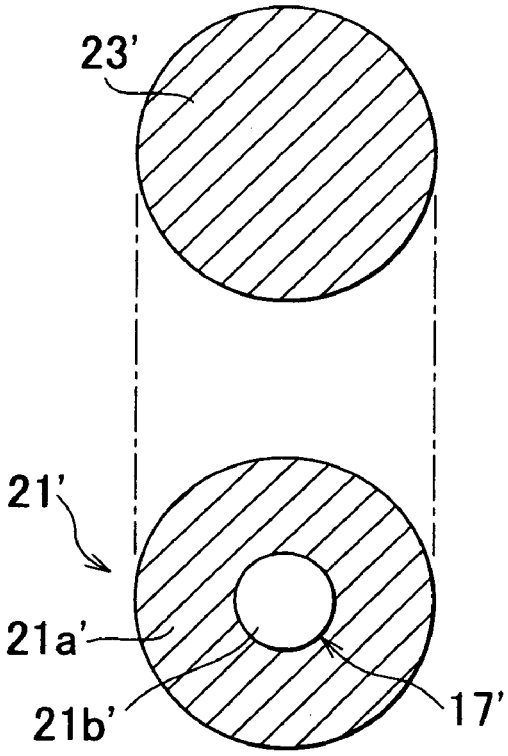
RELATED ART FIG. 12A
FIG. 12A and FIG. 12B are diagrams each explaining related art.
Figure 12B:
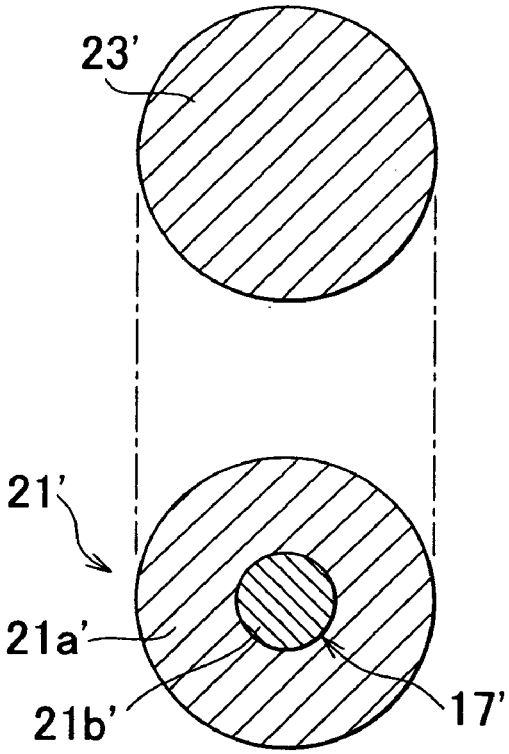
RELATED ART FIG. 12B

When the fuel injection is stopped as shown in FIG. 9A and FIG. 9B, the downward pressure of the pressurized fuel is applied to the first upward pressure receiving surface 23*a* and the second upward pressure receiving surface 23*b*, the upward pressure of the pressurized fuel is applied to the downward pressure receiving surface outer portion 21*a*, and the pressure of the pressurized fuel is not applied to the downward pressure receiving surface inner portion 21*b*, as shown by hatching in FIG. 10A. Subsequently, when the needle 10 is separated from the needle seat 16, the upward pressure of the pressurized fuel is applied not only to the downward pressure receiving surface outer portion 21*a*, but also to the downward pressure receiving surface inner portion 21*b*, as shown by hatching in FIG. 10B. At this time, the sum of the area of the first upward pressure receiving surface 23*a* and the area of the second upward pressure receiving surface 23*b* is substantially equal to the sum of the area of the downward pressure receiving surface outer portion 21*a* and the downward pressure receiving surface inner portion 21*b*. Therefore, when the needle 10 is separated from the needle seat 16, the downward pressure of the pressurized fuel applied to the needle 10 and the upward pressure of the pressurized fuel applied to the needle 10 can be balanced with each other.

Since other configurations and effects in the fifth embodiment are the same as in the first to fourth embodiments that have been described so far, description thereof will be omitted.

What is claimed is:

1. A fuel injection valve comprising:

a housing constituting a main body of the fuel injection valve;

a nozzle chamber and a coil chamber which are provided in the housing;

a sack which is provided at one end portion of the nozzle chamber;

a nozzle which is provided in a peripheral surface of the sack;

a slide portion which is provided so as to connect the nozzle chamber to the coil chamber;

a needle which extends from the nozzle chamber to the coil chamber through the slide portion, and which is supported in the slide portion so as to be slidable in a longitudinal axis direction;

a pressurized fuel source which is connected to the nozzle chamber, and which supplies pressurized fuel to the nozzle chamber so that the nozzle chamber is filled with the pressurized fuel;

a solenoid coil which is fixed in the coil chamber;

an armature which is provided on the needle at a portion positioned in the coil chamber such that the armature is opposed to the solenoid coil;

a compression spring which is inserted between an inner wall surface of the housing and an outer surface of the needle so as to apply force to the needle in a valve closing direction; and a needle seat which is provided in a vicinity of the nozzle, wherein:

when the needle is seated at the needle seat in the vicinity of the nozzle, an annular seal is formed between the needle and the needle seat;

the fuel injection valve includes a bottom portion side extending portion that extends in the longitudinal axis direction from a needle bottom surface inner portion, which is a portion of a bottom surface of the needle on an inner side of the annular seal, into the sack beyond the nozzle chamber;

when the needle is seated at the needle seat, upward pressure of the pressurized fuel is applied only to a downward pressure receiving surface outer portion that is an annular portion of a downward pressure receiving surface on an outer side of the annular seal, the downward pressure receiving surface being formed in the needle at a portion positioned in the nozzle chamber; and when the needle is separated from the needle seat, the upward pressure of the pressurized fuel is applied to an entire portion of the downward pressure receiving surface, the entire portion excluding a cross sectional area of the bottom portion side extending portion.

2. The fuel injection valve according to claim 1, wherein:

the bottom portion side extending portion is constituted by a bottom portion side bar-shaped member which is formed separately from the needle;

a bottom portion side receiving portion which extends in the longitudinal axis direction and opens at the needle bottom surface inner portion is formed in the needle; and the bottom portion side bar-shaped member is movably housed in the bottom portion side receiving portion, and a bottom end of the bottom portion side bar-shaped member is positioned in the sack.

3. The fuel injection valve according to claim 2, further comprising a fuel escape passage which is provided in the housing, wherein the bottom portion side receiving portion is connected to the fuel escape passage on a side opposite to the needle bottom surface inner portion.

4. The fuel injection valve according to claim 1, wherein:

the pressurized fuel source is connected to the coil chamber so that the coil chamber is filled with the pressurized fuel, and downward pressure of the pressurized fuel is applied to an upward pressure receiving surface which is formed in the needle at a portion positioned in the coil chamber;

a top portion side extending portion is provided, the top portion side extending portion extending from a top surface of the needle that is positioned in the coil chamber to an inner wall surface of the coil chamber;

the top portion side extending portion is fixed to the housing which defines the coil chamber, and is movable with respect to the needle, or the top portion side extending portion is fixed to the needle, and is movable with respect to the housing which defines the coil chamber; and a cross sectional area of the top portion side extending portion is set such that an area of the upward pressure receiving surface becomes substantially equal to an area of the downward pressure receiving surface when the needle is separated from the needle seat.

5. The fuel injection valve according to claim 4, wherein:

the top portion side extending portion is constituted by a top portion side bar-shaped member which is formed separately from the needle;

a top portion side receiving portion which extends in the longitudinal axis direction, and opens at the inner wall surface of the coil chamber is formed in the housing; and the top portion side bar-shaped member is movably housed in the top portion side receiving portion, and a bottom end of the top portion side bar-shaped member is fixed to the top surface of the needle.

6. The fuel injection valve according to claim 4, wherein:

the top portion side extending portion is constituted by a top portion side bar-shaped member which is formed separately from the needle;

a top portion side receiving portion which extends in the longitudinal axis direction, and opens at the top surface of the needle is formed in the needle; and the top portion side bar-shaped member is movably housed in the top portion side receiving portion, and a top end of the top portion side bar-shaped member is fixed to the housing which defines the coil chamber.

7. The fuel injection valve according to claim 6, wherein:

the bottom portion side extending portion is constituted by a bottom portion bar-shaped member which is formed separately from the needle;

a bottom portion side receiving portion which extends in the longitudinal axis direction, and which opens at the needle bottom surface inner portion is formed in the needle;

the bottom portion side bar-shaped member is movably housed in the bottom portion side receiving portion, and a bottom end of the bottom portion side bar-shaped member is positioned in the sack;

a through portion is formed in the needle so as to extend through the needle in the longitudinal axis direction from the needle bottom surface inner portion to the top surface of the needle; and the top portion side receiving portion and the bottom portion side receiving portion are constituted by the through portion.

8. The fuel injection valve according to claim 1, wherein:

the coil chamber is divided into a high pressure chamber and a low pressure chamber by a partition wall;

the needle extends through the partition wall slidably and hermetically, and extends from the high pressure chamber to the low pressure chamber;

the solenoid coil is positioned in the low pressure chamber, and the pressurized fuel source is connected to the high pressure chamber so that the high pressure chamber is filled with the pressurized fuel; and downward pressure of the pressurized fuel is applied to an upward pressure receiving surface that is formed in the needle at a portion positioned in the high pressure chamber.

9. The fuel injection valve according to claim 8, wherein:

the needle includes a small-diameter portion which extends through the partition wall slidably and hermetically; and a cross sectional area of the small-diameter portion is set so as to be substantially equal to the cross sectional area of the bottom portion side extending portion.

10. The fuel injection valve according to claim 8, wherein:

the needle includes a concave groove which is formed inside the needle;

the concave groove is formed so as to be connected to the high pressure chamber; and a cross sectional area of an annular intermediate portion of the needle, which is formed by forming the concave groove, is set so as to be substantially equal to the cross sectional area of the bottom portion side extending member.

* * * * *